United States Patent [19]

Conner et al.

[11] 4,277,999

[45] Jul. 14, 1981

[54] FIREWOOD SAWMILL

[76] Inventors: Eldon C. Conner; E. C. Conner, both of Rte. 1, Foster, Okla. 73039

[21] Appl. No.: 72,941

[22] Filed: Sep. 6, 1979

[51] Int. Cl.[3] ..... B27B 31/00; B27B 5/02

[52] U.S. Cl. ..... 83/425.3; 83/435.2; 83/425.2; 83/109; 83/155; 83/165

[58] Field of Search ..... 83/435.2, 425.3, 425.2, 83/425.4, 155, 165, 109

[56] References Cited

U.S. PATENT DOCUMENTS

| | | | |
|---|---|---|---|
| 238,815 | 3/1881 | Stearns | 83/435.2 |
| 482,799 | 9/1892 | Maffett et al. | 83/425.3 |
| 799,837 | 9/1905 | Dittbenner | 83/435.2 |
| 832,273 | 10/1906 | Perron | 83/435.2 |
| 1,060,793 | 5/1913 | Segraves | 83/435.2 |
| 1,123,056 | 12/1914 | Wooster | 83/425.3 |
| 2,569,878 | 10/1951 | Avinger et al. | 83/435.2 |
| 4,005,625 | 2/1977 | Brochu et al. | 83/435.2 |

*Primary Examiner*—Donald R. Schran
*Attorney, Agent, or Firm*—Robert K. Rhea

[57] ABSTRACT

An upright rectangular frame longitudinally journals an axle supporting a plurality of spaced-apart circular saws. The axle is V-belt driven by an engine at one end of the frame. A feed conveyor, disposed laterally of the frame, moves logs deposited thereon toward the saws in response to a manually operated lever moving an idler pulley and tightening a flat belt entrained around a feed conveyor driving pulley and frictionally engaging a pulley on the axle. The sawed logs are moved out of the frame by a belt conveyor.

1 Claim, 4 Drawing Figures

FIREWOOD SAWMILL

BACKGROUND OF THE INVENTION

1. Field of the Invention

The present invention relates to sawmills and more particularly to a firewood cutting device.

Since firewood is marketed by ricks it is desirous to provide a sawing device to cut logs in selected lengths which, after being split to firewood size, may be easily stacked to form the required dimensions for a rick of firewood.

This invention provides an apparatus for cutting a firewood forming log into a plurality of selected equal lengths to be thereafter split, as desired.

2. Description of the Prior Art

It is well known to provide an equal length workpiece sawing machine comprising a pair of spaced circular saws to cut logs, planks or lath to equal length by passing the wooden material between the saws.

U.S. Pat. No. 1,123,056 discloses a cord wood cutting device having a pair of frame journalled power driven saws including a disk journalled by the frame parallel with the saws and provided with radially projecting stops which receive firewood logs and move the logs toward and beyond the saws as the logs are successively positioned on the stops. The cord length sawed logs fall by gravity to a conveyor for movement toward a disposal point.

This invention is distinctive over this patent by providing a manually operated slip clutch flat belt drive for a conveyor feeding logs horizontally toward a plurality of equally spaced saws in a plane disposed below a horizontal plane taken diametrically through the saws wherein the slip belt control permits interruption of the feed conveyor action in the event of malfunction of any of the equipment or wood being cut.

SUMMARY OF THE INVENTION

A rectangular open frame horizontally journals an axle having a plurality of equally spaced circular saws secured thereto. A clutch equipped engine at one end of the frame drives the saw axle by V-belts and pulleys. A feed conveyor, disposed laterally of one side of the frame, is driven by a flat belt entrained over an idler pulley manually moved by a lever for contact between the belt and a feed conveyor drive pulley mounted on the saw axle. The upper limit of the feed conveyor defines a horizontal plane disposed below a horizontal plane taken diametrically through the saws a distance sufficient to position the upper limit of the logs to be sawed below the horizontal plane through the diameter of the saws so that the cutting action of the saws on the logs is downwardly directed against the conveyor and its log moving stops. A hopper, extending longitudinally within the frame, receives sawed lengths of the logs and is provided with a belt conveyor for discharging the sawed logs from the frame at its end opposite the engine. The belt conveyor is driven by a belt and pulley arrangement connected with the saw axle.

The principal object is to provide a sawmill for cutting trees and limbs to firewood lengths.

DESCRIPTION OF THE PREFERRED EMBODIMENT

Figures 1, 2:
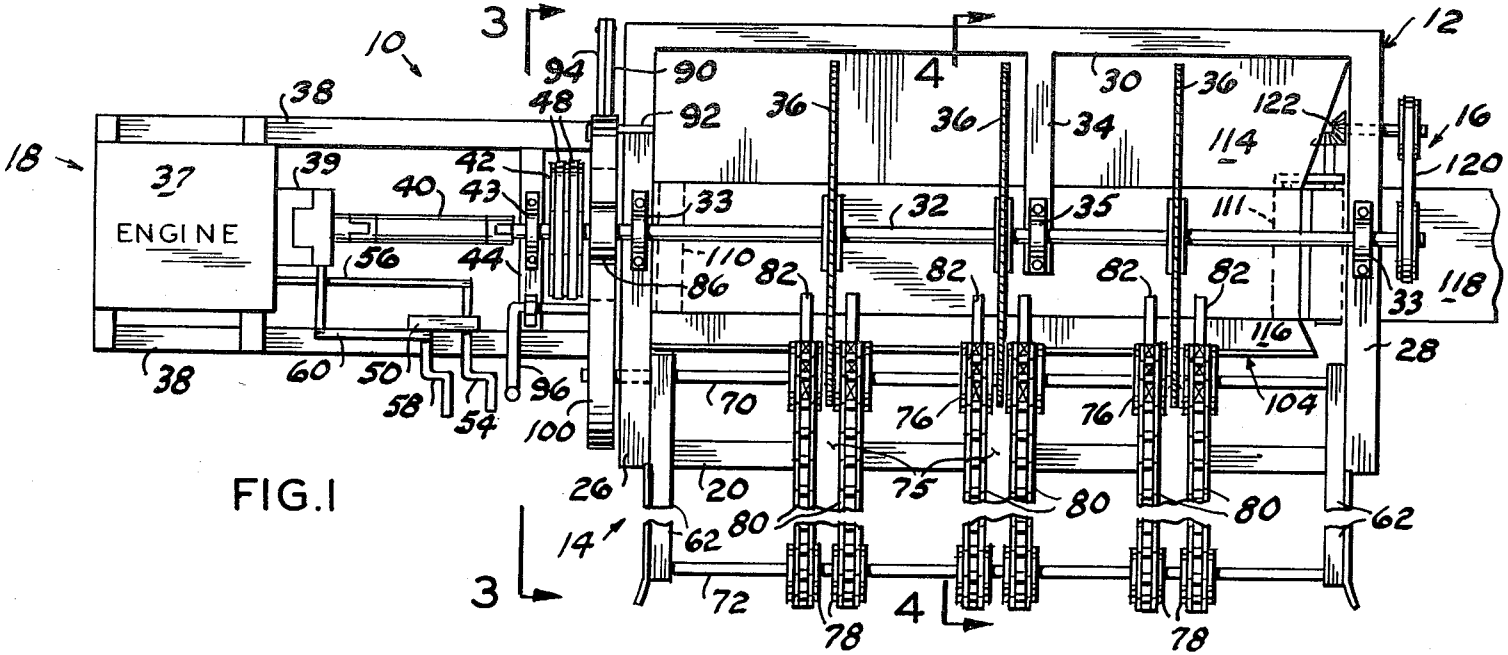
FIG. 1 is a fragmentary top view of the sawmill.
FIG. 2 is a fragmentary side elevational view.

Like characters of reference designate like parts in those figures of the drawings in which they occur.

In the drawings:

The reference numeral 10 indicates the device, as a whole, which is substantially rectangular in general configuration comprising a saw supporting frame means 12, a feed conveyor means 14, an outlet conveyor means 16, and engine and control means 18. The saw frame means 12 is of the open framework type having elongated base side rails 20 joined by base end rails 22 with a plurality of posts 24, one for each corner of the frame, secured to the juncture of the side and end base rails. Frame top end rails 26 and 28 are secured to the upper limit of the frame posts 24 in vertically spaced parallel relation with respect to the frame base end rails 22. A top rail 30 joins the ends of the frame top end rails 26 and 28 at the rearward side of the frame.

An elongated axle 32 longitudinally overlies the frame 12 and is journalled at its respective end portions by a pair of bearings 33 secured to the top end rails 26 and 28. A stub rail 34, extending horizontally forward from the frame top rail 30, supports the axle 32 intermediate its ends by another bearing 35. A plurality of circular saw blades 36 are coaxially secured to the axle 32 in equally spaced relation with the spacing between any two blades equal to the spacing between the respective endmost blade and the inward surface of the adjacent top end rail of the frame for the purpose of transversely sawing a log of predetermined length to form a plurality of equal length sections, as hereinafter explained.

The engine control means 18 comprises an engine 37 mounted on base members or skids 38 extending longitudinally from the left end of the frame 12, as viewed in FIGS. 1 and 2, and having a clutch 39 connected with its drive shaft and in turn driving a universal joint equipped drive shaft 40 coaxially connected with a V-belt drive pulley 42 journalled by a pair of bearings 43 mounted on engine frame cross braces 44. An axle V-belt driven pulley 46, mounted on the left end of the axle, as viewed in FIGS. 1 and 2, is driven by belts 48 entrained around the drive pulley 42 and driven pulley 46 for angularly rotating the saw blades 36 in the direction of the arrow 47.

An engine instrument panel 50 is mounted on a standard 52 laterally of the drive shaft 40. A throttle control pedal 54 is supported by the engine skid 38 adjacent the standard 52 and connected with the engine by linkage 56. Similarly, a clutch control pedal 58, supported by the skid 38 adjacent the standard 52, is connected by linkage 60 with the clutch 39.

The feed conveyor means 14 comprises a pair of supports 62 (FIG. 1) secured to the frame posts 24 opposite the frame rearward rail 30 and projecting horizontally forward from the frame. A pair of vertical standards 64, disposed laterally of the forward side of the frame, support the supports 62 in a horizontal plane intermediate the height of the frame. An elongated conveyor drive shaft 70 extends between and is journalled by the end portions of the supports 62 within the frame and a conveyor idler shaft 72 extends horizontally between and is journalled by the other end portions of the supports 62. A plurality of pairs of vertical supports 74, one pair for the position of each saw blade 36, extend, respectively, vertically above the forward frame side rail 20 and depend from the position of the idler shaft 72 for supporting plank-like conveyor chain platforms 75. A pair of sprocket wheels 76 is secured to the conveyor drive shaft 70 on opposing sides of the vertical plane defined by the respective circular saw 36. Similarly, a pair of flat faced pulleys 78 are journalled by the idler shaft 72 in cooperative alignment with the respective sprocket 76.

A pair of chains 80 are entrained around the respective pairs of sprockets 76 and idler pulleys 78. The upper run of the chains are horizontally supported by the platforms 75. Selected links of each chain 80 are provided with outstanding log push-lugs or stops 82 for contacting and moving logs 84, or the like, toward the saws 36 in the manner presently explained.

One end of the conveyor drive shaft 70 projects beyond the engine connected end of the frame and is coaxially connected with a flat belt drive pulley 85. Similarly, a flat belt pulley 86 is coaxially connected with the saw arbor or axle 32 between the saw drive pulley 46 and adjacent axle bearing 33. A flat belt idler pulley 88 is mounted on one end of an elongated arm 90 pivotally connected, as at 92, with the frame top end rail 26. The depending end of the arm 90 is connected by linkage 94 with a feed conveyor control handle 96, journalled by the drive pulley support 44, so that movement of the upper end of the handle 96, forwardly of the frame in the direction of the arrow 98, moves the idler pulley 88 toward the rearward side of the frame to tighten a flat belt 100 entrained around the conveyor drive pulley 85 and idler pulley 88 and in frictional contact with the axle flat pulley 86 for angularly rotating the feed conveyor drive shaft 70 and moving the upper run of the chains 80 and their stops 82 toward the rotating saws. Conversely, moving the handle 96, in the direction of the arrow 102, reduces the tension on the flat belt 100 and stops angular rotation of the saws 36 and conveyor drive pulley 85.

The outlet conveyor means 16 comprises a hopper 104 formed by a trough-like base portion 106 extending longitudinally of the frame between the base end rails 22 and provided with a conveyor belt 108 supported between suitable rollers 110 and 111 at the respective ends of the trough 106. The hopper further includes upwardly diverging side walls 114 and 116 within the respective rearward and forward side portions of the frame.

The hopper 106 is open at its end opposite the engine means and communicates with a dispensing conveyor 118. The dispensing conveyor 118 is driven by belt and pulley means 120 connected with the saw axle 32 driving angle gears 122 in turn driving the dispensing conveyor 118. Other belt and pulley means, connected with the driven shaft of the angle gears also drives the hopper conveyor roller 111.

OPERATION

Figure 3:
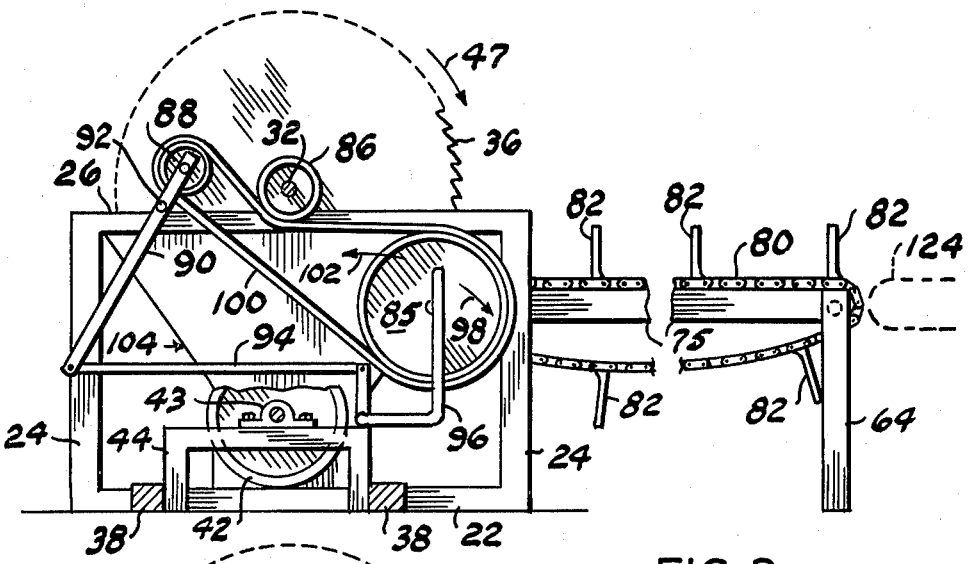
FIG. 3 is a fragmentary end elevational view, partially in section, looking in the direction of the arrows 3—3 of FIG. 1, with parts broken away for clarity; and, FIG. 4 is a fragmentary vertical cross sectional view, partially in elevation, taken substantially along the line 4—4 of FIG. 1.
Figure 4:
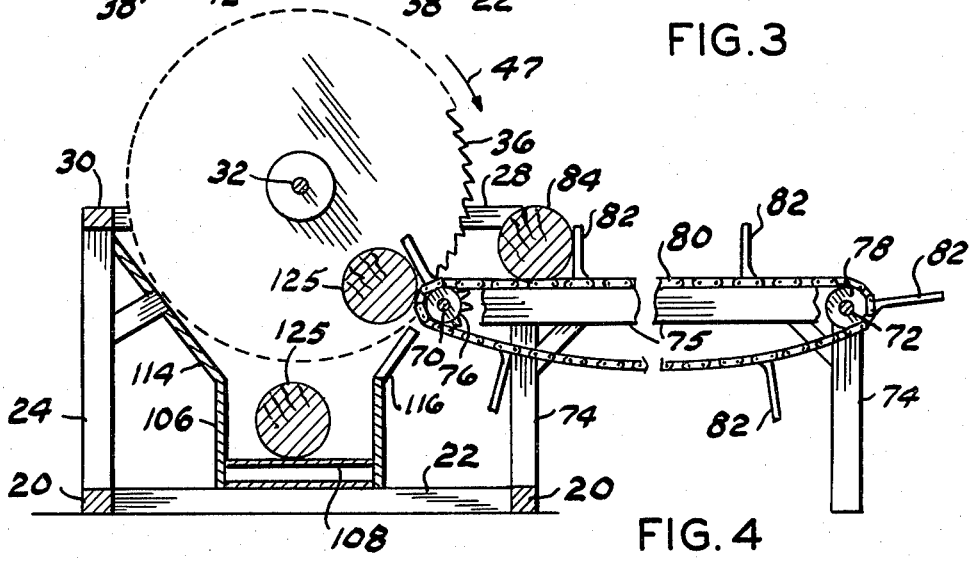

In operation, with the device assembled, as hereinabove described, and with the engine 37 running the clutch is engaged for driving the saws 36. The logs 84, to be sawed, are precut a length equal to the longitudinal length of the frame, are disposed adjacent the feed conveyor means 14 by a conventional conveyor, indicated by the dotted lines 124 (FIG. 3). With the handle 96 manually operated to drive the conveyor drive pulley 85 the feed conveyor chain stops engage the logs 84 and move them toward the saws 36, as best illustrated by FIG. 4, so that, after being severed, the resulting billets 125 fall by gravity into the hopper means 104 and are conveyed outwardly of the frame.

Obviously the invention is susceptible to changes or alterations without defeating its practicability. Therefore, we do not wish to be confined to the preferred embodiment shown in the drawings and described herein.

We claim:

1. A firewood sawmill, comprising:

a rectangular saw frame having base members and upstanding posts supporting saw frame end rails at the respective ends of the frame and defining a forwardly open lateral side for the saw frame;

a saw axle longitudinally overlying and projecting horizontally beyond the respective ends of said saw frame, said frame having downwardly and inwardly converging side walls terminating in a trough-like base forming a sawed firewood hopper extending longitudinally of the saw frame below said axle;

bearings on said saw frame end rails journalling said axle;

a plurality of equally spaced circular saws coaxially secured to said axle;

an engine having a clutch drivably connected with a drive shaft;

V-belts and pulleys drivably connecting said engine drive shaft with said axle;

manually operated control handles connected with said engine and said clutch;

a feed conveyor frame disposed laterally of said saw frame and projecting into its laterally open side between vertical planes defining the end limits of said saw frame for moving logs to be sawed toward said saws, said feed conveyor frame comprising a pair of elongated supports horizontally secured at one end portion, respectively, to the respective end of said saw frame, and a pair of standards supporting the other end portion of said supports for supporting the upper limit of the feed conveyor frame below the horizontal plane of said saw axle a distance at least equal to the diameter of logs to be sawed;

a feed conveyor drive shaft journalled by the saw frame connected end portions of said feed conveyor frame supports in parallel laterally spaced relation with respect to said axle;

a feed conveyor idler shaft journalled by the other end portions of said feed conveyor frame supports;

a chain support platform extending horizontally between said feed conveyor drive shaft and said feed conveyor idler shaft in cooperative alignment with the respective said saw;

a plurality of pairs of sprockets secured in spaced-apart relation to said feed conveyor drive shaft in cooperative alignment with the respective said saw;

a like plurality of pairs of feed conveyor idler shaft pulleys journalled by said feed conveyor idler shaft in cooperative alignment with said pairs of sprockets;

a feed conveyor chain entrained around the respective aligned sprocket and idler pulley;

a plurality of outstanding stops secured to the respective said chain;

a feed conveyor driving pulley secured to said feed conveyor drive shaft;

a friction drive pulley secured to said axle in cooperative alignment with said feed conveyor driving pulley;

a flat belt idler pulley pivotally supported by said saw frame for movement in a vertical plane toward and away from said friction drive pulley;

a flat belt entrained around said flat belt idler pulley and said feed conveyor driving pulley in contact with said friction drive pulley;

handle and linkage means for moving said flat belt idler pulley;

a flat belt conveyor extending longitudinally of said trough; and,

V-belt pulley and angle gear means drivably connecting said axle with said flat belt conveyor for moving sawed firewood toward one end of said frame.

* * * * *